US006454589B1

(12) United States Patent
Yeh

(10) Patent No.: US 6,454,589 B1
(45) Date of Patent: Sep. 24, 2002

(54) I/O CONNECTOR WITH IMPROVED BUTTON MECHANISM

(75) Inventor: Joel J. Yeh, San Ganrie, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/949,135

(22) Filed: Sep. 6, 2001

(51) Int. Cl.[7] ..... H01R 13/62
(52) U.S. Cl. ..... 439/352; 439/76.1; 200/51 R
(58) Field of Search ..... 439/352, 76.1, 439/188; 200/51.01–51.11, 51 R

(56) References Cited

U.S. PATENT DOCUMENTS 5,634,809 A * 6/1997 Hirai ..... 439/352
5,951,317 A * 9/1999 Tracy et al. ..... 439/352
5,954,531 A * 9/1999 Jennings et al. ..... 439/352
6,113,413 A * 9/2000 Cronin et al. ..... 439/352
6,116,937 A * 9/2000 Pan ..... 439/352
6,132,231 A * 10/2000 Suzuki ..... 439/352
6,146,180 A * 11/2000 Betker et al. ..... 439/352
6,149,450 A * 11/2000 Gastineau ..... 439/352
6,174,190 B1 * 1/2001 Tharp et al. ..... 439/352

* cited by examiner

*Primary Examiner*—Gary F Paumen
(74) *Attorney, Agent, or Firm*—Wei Te Chung

(57) ABSTRACT

An I/O connector (1) has a top cover (10), a bottom cover (20), a terminal module (30), a printed circuit board (PCB, 40), a switch (50), a latch (60), and a metal plate (70). The switch is soldered on the PCB while the PCB is soldered to contacts of the terminal module. The latch extends through the terminal module with a pair of pawls (61) and a pair of push beams (65) respectively exposed ahead and above the terminal module. The top cover has a latch release button (11) and a hot button (12), and a barrier (13) is disposed therebetween. A pair of latch actuators (14) downwardly extends from the latch release button to actuate the push beams. A switch actuator (16) downwardly extends from the hot button to actuate a push pole (51) of the switch. The metal plate is mounted to the top cover and being extended through by the switch actuator and a pair of push arms (63) of the latch.

1 Claim, 6 Drawing Sheets

I/O CONNECTOR WITH IMPROVED BUTTON MECHANISM

FIELD OF THE INVENTION

The present invention generally relates to an I/O connector, and more particularly to an I/O connector having an improved button mechanism.

BACKGROUND OF THE INVENTION

Portable electronic devices such as mobile phone and personal digital assistant (PDA) have been widely used in everyday life in recent years. They often employ I/O connectors that integrate terminal modules to perform charging or communicating with other electronic devices such as personal computers (PCs). Such a terminal module generally has a latch mechanism to engage with a corresponding I/O port of a PC. An actuator associated with a latch mechanism is usually formed on a cover of the I/O connector to control the engagement or disengagement of the latch. When a user presses on the actuator, the latch pawls of the latch mechanism can disengage from the corresponding port.

When such a portable electronic device is communicated with a PC, it is usually needed to control the message bits transmitted therebetween. I/O connectors of prior arts do not have such control instruments, and a usual solution is to add an additional cradle to accomplish such control function. However, it is a costly solution and the additional cradle is inconvenient to carry.

Hence, an improved I/O connector with latch mechanism and with the function of controlling transmission of message bits is needed.

BRIEF SUMMARY OF THE INVENTION

A primary object of the present invention is to provide an I/O connector that can conveniently release latch engagement and control transmission of message bits.

An I/O connector according to the present invention includes a top cover, a bottom cover, a terminal module, a printed circuit board (PCB), a switch, a latch, a metal plate, and a strain relief. The top cover interlocks with the bottom cover thus forming a receiving space therebetween. The top cover has a hot button in its middle part and a latch release button in its forward part. A barrier separates the hot button from the latch release button. A switch actuator and a pair of latch actuators respectively downwardly extend from the hot button and the latch release button. The terminal module receiving a plurality of contacts is mounted on the bottom cover and forwardly extends from front end of the enclosed covers. The PCB is soldered to a plurality of solder portions of the contacts and is supported by frames of the bottom cover. The switch is mounted between the PCB and the switch actuator. The strain relief is retained in a rear part of the receiving space. The latch extends through the I/O connector with a pair of pawls extending outside of the terminal module and a pair of push beams actuated by the latch actuators. The metal plate is mounted to the top cover and is extended through by the switch actuator and a pair of push arms of the latch. Thus, a user can control the latch engagement by pressing the latch release button and control transmission of the message bits by pressing the hot button.

Other objects, advantages and novel feather of the invention will become more apparent from the following detailed description when taken in conjunction with the accompanying drawings.

DETAILED DESCRIPTION OF THE INVENTION

Figure 1:
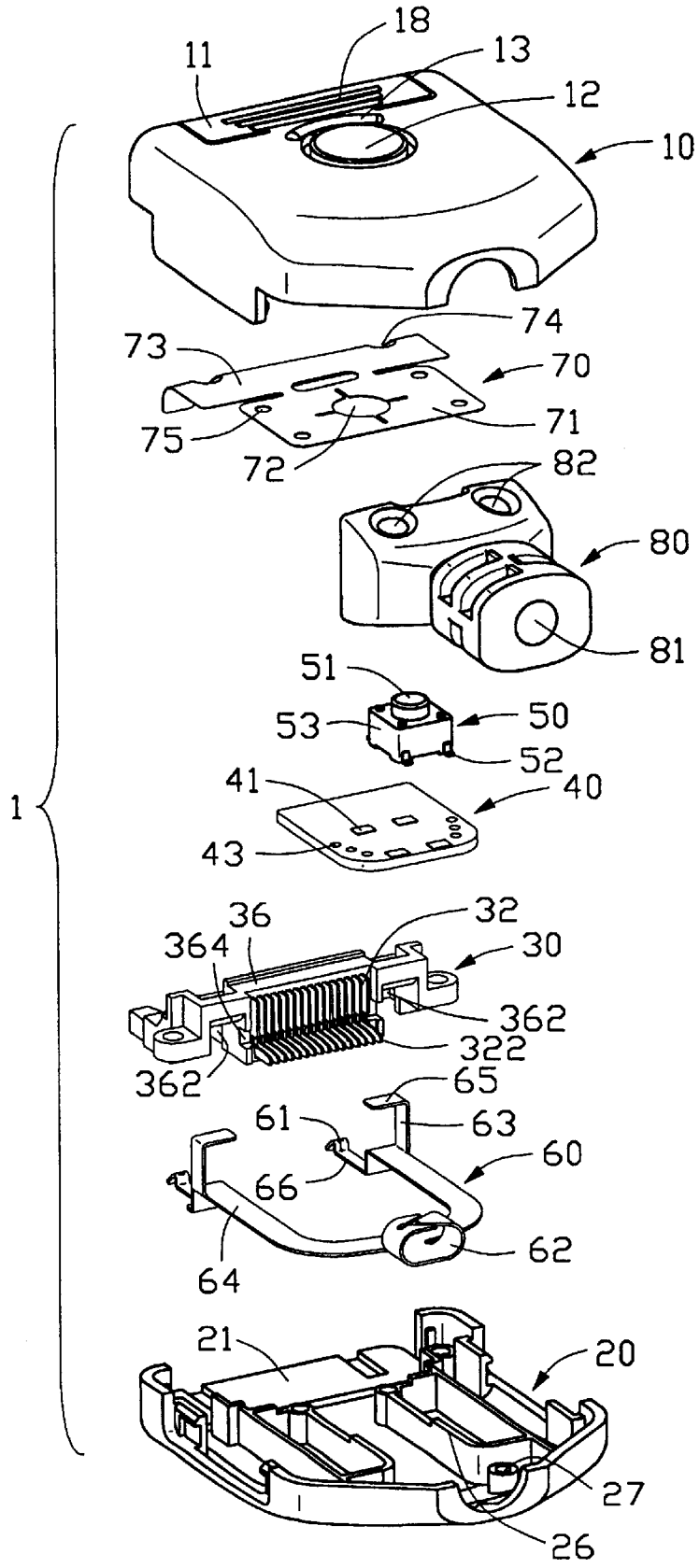
FIG. 1 is an exploded view of an I/O connector according to the present invention.
Figure 2:
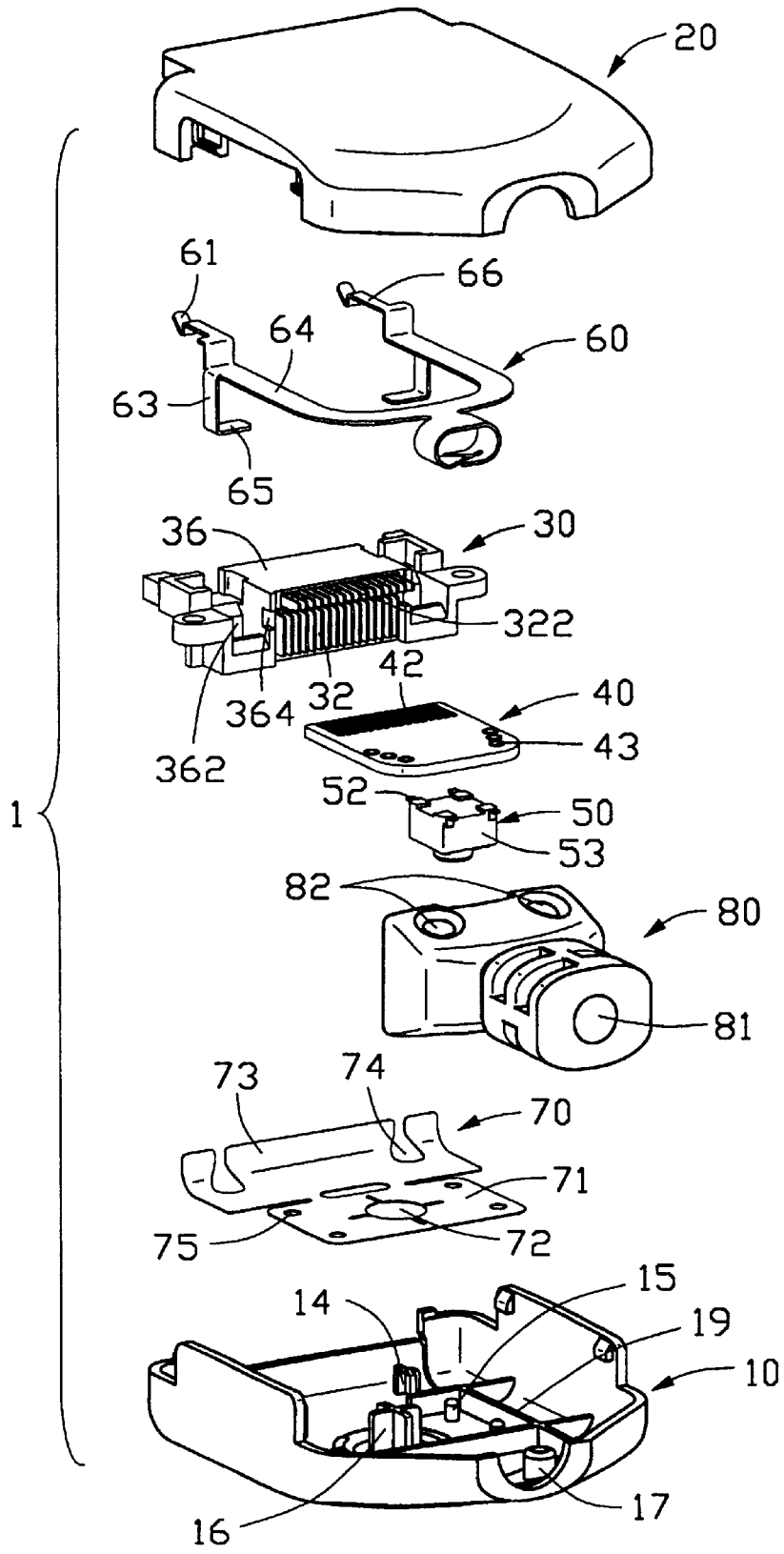
FIG. 2 is similar to FIG. 1, but taken from another angle of view.

Referring to FIGS. 1 and 2, an I/O connector 1 according to the present invention includes a top cover 10, a bottom cover 20, a terminal module 30, a printed circuit board (PCB) 40, a switch 50, a latch 60, a metal plate 70, and a strain relief 80.

The top cover 10 has a hot button 12 in its middle part, and a switch actuator 16 downwardly extends from the hot button 12. A latch release button 11 is placed in a front part of the top cover 10, and a pair of latch actuators 14 downwardly extends from the latch release button 11. A plurality of projections 18 upwardly projects from the latch release button 11 for the user to touch easily. A barrier 13 separates the latch release button 11 from the hot button 12, thus the user can press the hot button 12 or the latch release button 11 while not affect each other. Four positioning poles 15 downwardly extend from the top cover 10 around the switch actuator 16. Top positioning frames 19 downwardly extend from the top cover 10 around the positioning poles 15. A pair of top mounting poles 17 downwardly extends from a rear end of the top cover 10.

The bottom cover 20 has a mounting flat 21 disposed on its front part. Bottom positioning frames 26 upwardly extend from middle and rear part of the bottom cover 20. A pair of bottom mounting poles 27 upwardly extends from a rear end of the bottom cover 20.

Figure 3:
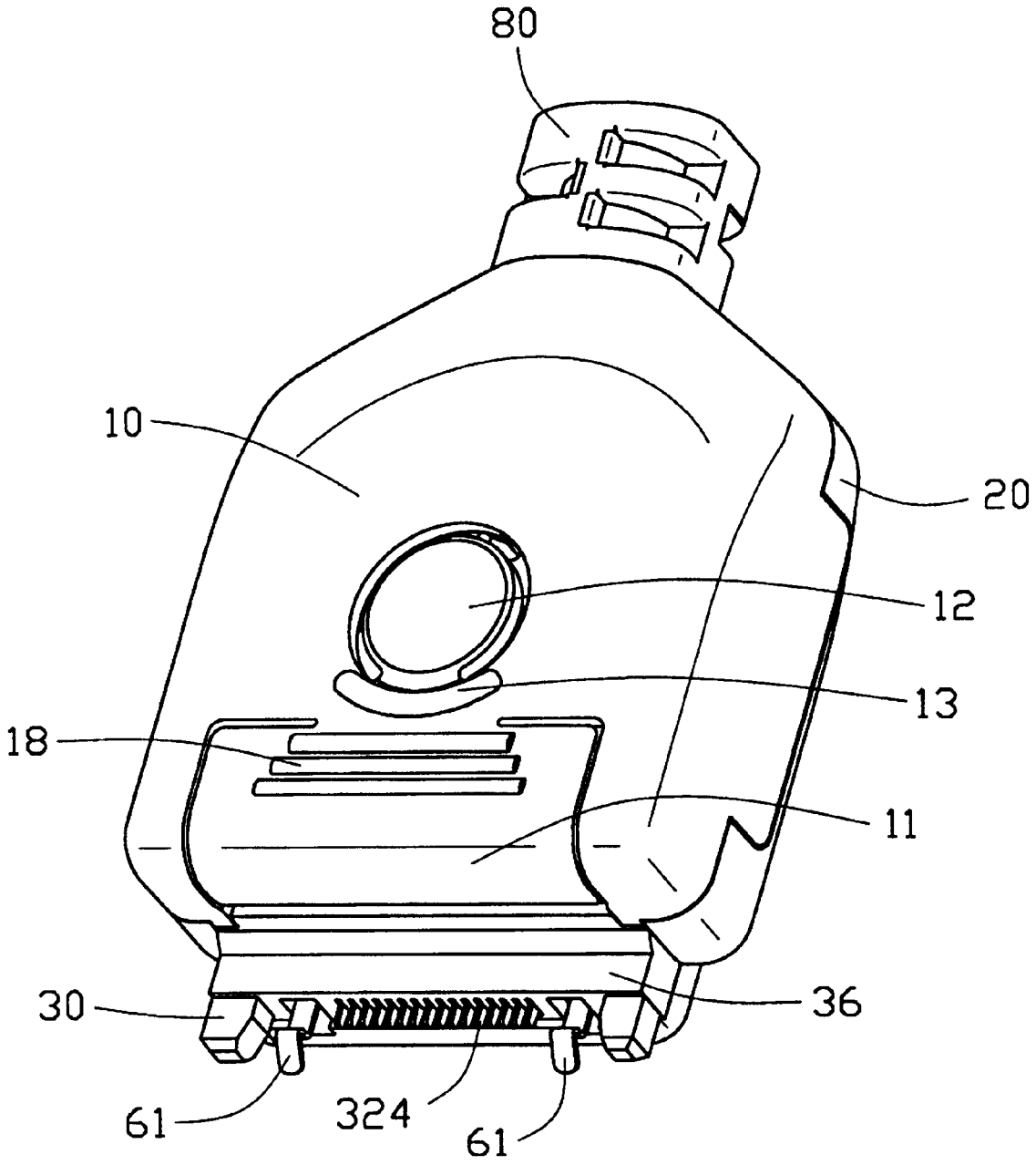
FIG. 3 is an assembled view of FIG. 1.
Figure 4:
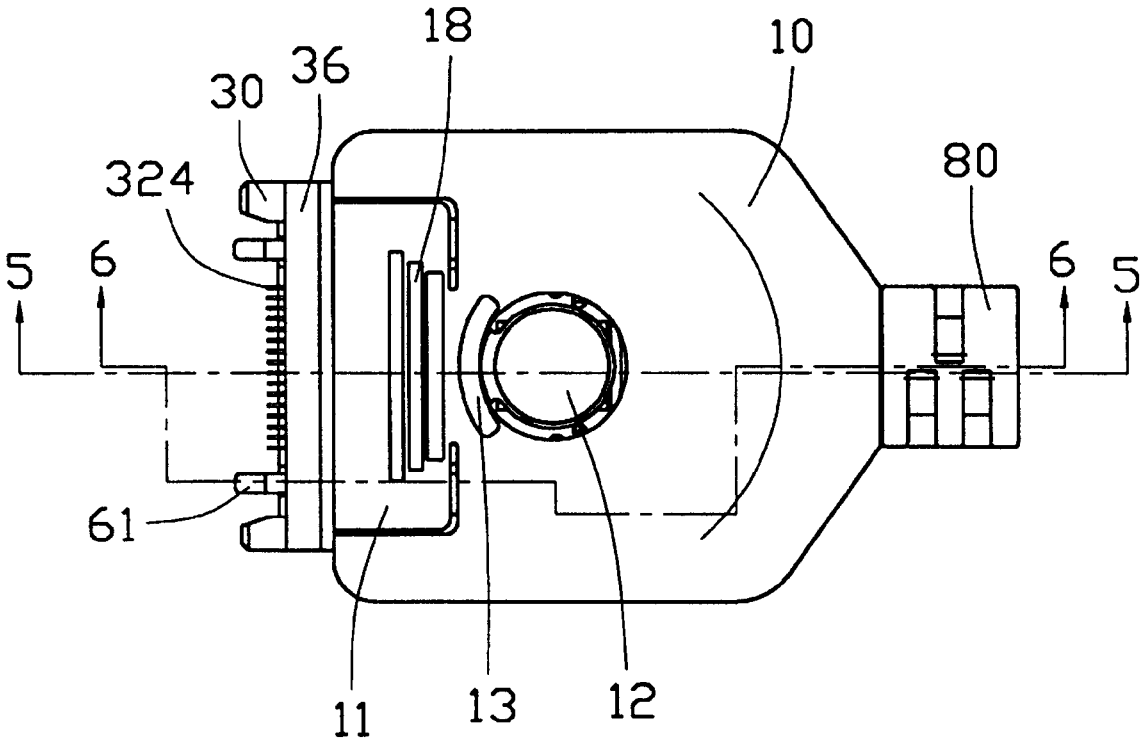
FIG. 4 is a top view of FIG. 3.
Figure 5:
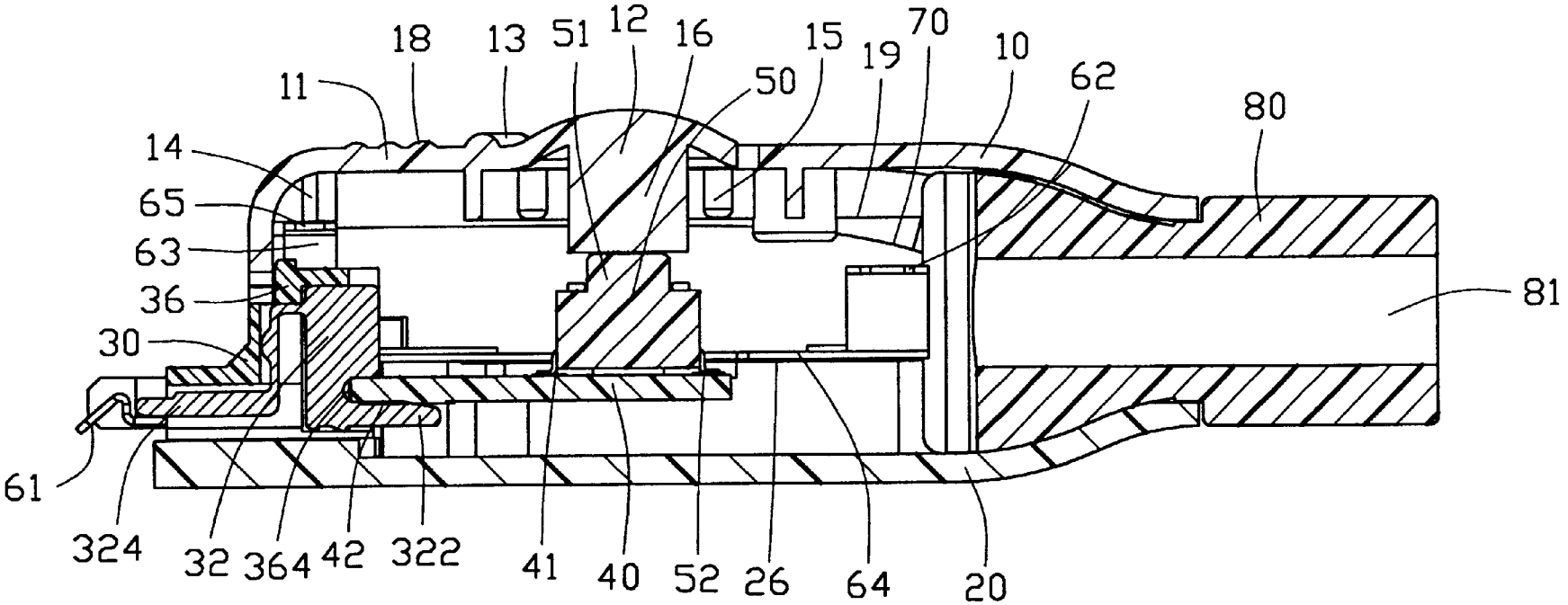
FIG. 5 is a cross-sectional view taken along line 5—5 of FIG. 4.
Figure 6:
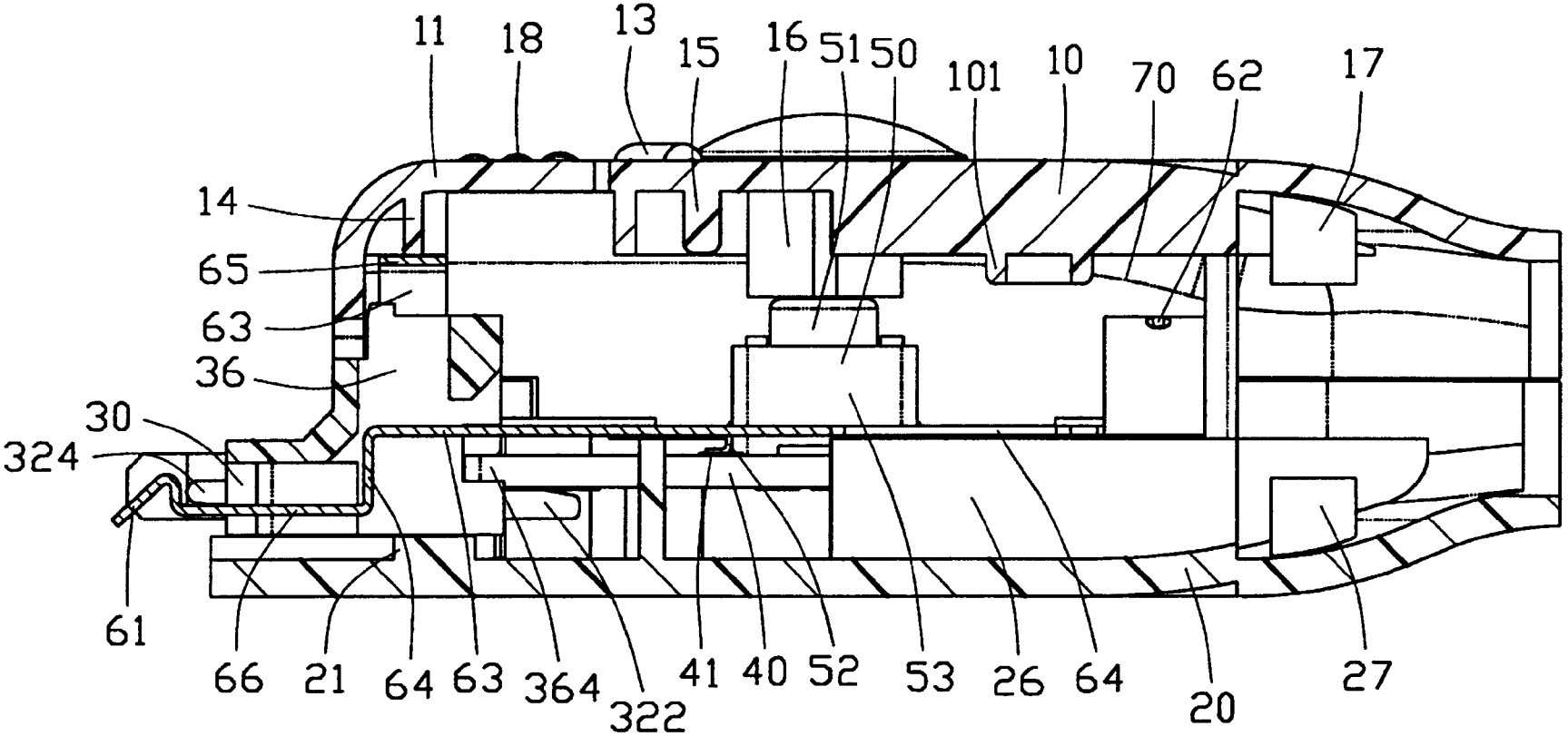
FIG. 6 is a cross-sectional view taken along line 6—6 of FIG. 4, wherein the strain relief is removed.

The terminal module 30 includes a housing 36 and a plurality of contacts 32 retained in the housing 36. Each contact 32 has a contact portion 324 (shown in FIG. 3) forwardly extending from a front face of the housing 36 and a solder portion 322 rearwardly extending from a rear face of the housing 36. A pair of notches 364 is inwardly disposed in backside walls (not labeled) of the housing 36. A pair of mounting channels 362 is defined through the housing 36 for insertion of the latch 60.

The PCB 40 substantially is a rectangular structure. Four pads 41 are provided on a top surface of the PCB 40. A plurality of traces 42 is disposed on a front edge of a bottom surface of the PCB 40. Six holes 43 are defined symmetrically in a rear part of the PCB 40.

The switch 50 has a body 53. Four solder feet 52 are provided at four corners of a bottom surface of the body 53. A push pole 51 upwardly extends from the body 53.

The latch 60 is a U-shaped structure. A crimping 62 is formed at a rear end of the latch 60. A pair of latch arms 64 forwardly extends from the crimping 62. A pair of push arms 63 respectively upwardly extends from a forward end of each latch arm 64. Each push arm 63 has a push beam 65 horizontally bent from its free end. A pawl arm 66 downwardly then forwardly extends from a free end of each latch arm 64. Each pawl arm 66 forms a pawl 61 at its free end.

The metal plate 70 includes a planar portion 71 and a bent portion 73 downwardly bent from a forward edge of the planar portion 71. A central hole 72 is defined in a middle part of the planar portion 71, and four positioning holes 75 are defined around the central hole 72. A pair of retaining cutouts 74 is defined in the bent portion 73.

The strain relief 80 defines a cable entry 81 therethrough. Two pairs of mounting holes 82 are respectively defined in top surface and bottom surface of a front end of the strain relief 80.

Referring to FIGS. 3–6, in assembly, the latch 60 is inserted from a rear face of the terminal module 30 through the mounting channels 362, with the push beams 65 exposed above a top surface of the housing 36 and the pawls 61 exposed ahead a front end of each contact portion 324. The switch 50 is soldered onto the PCB 40, with the solder feet 52 respectively soldered on the pads 41. The front end of the PCB 40 is inserted into the notches 364, with the traces 42 being soldered to the solder portions 322 of the contacts 32. The terminal module 30, the PCB 40, the switch 50, the latch 60, and the strain relief 80 are mounted onto the bottom cover 20, with the terminal module 30 supported on the mounting flat 21 while the PCB 40 and the latch 60 being respectively supported by the bottom positioning frames 26, and with a pair of the mounting holes 82 being respectively inserted by the bottom mounting poles 27. The metal plate 70 is mounted to the top cover 10, with the central hole 72 being extended through by the switch actuator 16 and the retaining cutouts 74 being extended through by the push arms 63. The top cover 10 is interlocked with the bottom cover 20 in any convenient way, with the top mounting poles 17 inserted into another pair of the mounting holes 82 of the strain relief 80. Now, a bottom surface of the switch actuator 16 abuts against a top surface of the push pole 51, and a bottom surface of each latch actuator 14 abuts against a top surface of each push beam 65. Thus the I/O connector 1 according to the present invention is obtained.

In use, when a portable electronic device such as a personal digital assistant (PDA, not shown) is electrically connected to a personal computer (PC, not shown) by the I/O connector 1 and a cable (not shown) coupled therewith, the terminal module 30 is coupled to a corresponding port of the PC with the pawls 61 providing engagement and the contact portions 324 providing electrical contacting, and the cable electrically connects the I/O connector 1 to a corresponding port of the PDA. A user can press the latch release button 11 to separate the I/O connector 1 from the corresponding port of the PC. When the I/O connector 1 is engaged with the corresponding port of the PC, an electrical path is accomplished passing by the corresponding port of the PC, the contacts 32, the PCB 40, the cable, and the corresponding port of the PDA. The user can press the hot button 12 to control the transmission of message bits being communicated between the corresponding ports of the PC and the PDA. When the hot button 12 is pushed, the metal plate 70 and the switch actuator 16 will move downwardly, then the metal plate 70 will bound up, thus a physical pulse is transmitted to the switch 50 by the push pole 51. The switch 50 transfers the physical pulse to an electrical pulse by inner circuits (not shown) therein, then controlled by inner circuits of the PCB 40, the message bits being communicated in the PCB 40 will be shut off. When the hot button is pushed again, another electrical pulse is produced for recovering the transmission of message bits.

It is to be understood, however, that even though numerous, characteristics and advantages of the present invention have been set forth in the foregoing description, together with details of the structure and function of the invention, the disclosed is illustrative only, and changes may be make in detail, especially in matters of shape, size, and arrangement of parts within the principles of the invention to the full extent indicated by the broad general meaning of the terms in which the appended claims are expressed.

What is claimed is:

1. An I/O connector comprising:

a top cover having a hot button and a latch release button, a switch actuator downwardly extending from the hot button, a pair of latch actuators downwardly extending from the latch release button;

a bottom cover interlocked with the top cover;

a terminal module mounted on the bottom cover and having a housing and a plurality of contacts retained in the housing;

a printed circuit board (PCB) soldered to said contacts;

a switch soldered on the PCB and having a push pole for being actuated by the switch actuator;

a latch having a pair of push arms extending through the terminal module and a pair of push beams exposed above the housing of the terminal module for being actuated by the latch actuators; and a metal plate mounted to the top cover and being extended through by the switch actuator and the push arms of the latch;

wherein the push pole of the switch abuts against the switch actuator of the top cover;

wherein the push beams of the latch abut against the latch actuators of the top cover;

wherein a barrier protrudes from a top surface of the top cover and separates the hot button from the latch release button;

wherein at least one projection is formed on the latch release button;

wherein the top cover has a plurality of positioning poles and top positioning frames to position the metal plate;

wherein the bottom cover has a mounting flat to support the terminal module and a plurality of bottom positioning frames to support the PCB and the latch.

* * * * *